US005762170A

United States Patent [19]

Shyr et al.

[11] Patent Number: 5,762,170

[45] Date of Patent: Jun. 9, 1998

[54] COMBINATION BRIEFCASE AND COMPUTER BAG ASSEMBLY

[75] Inventors: Michael H. Shyr; Godfrey S. Shyr, both of Hacienda Heights, Calif.

[73] Assignee: Goodhope Bags Ind., Inc., La Puente, Calif.

[21] Appl. No.: 584,130

[22] Filed: Jan. 11, 1996

[51] Int. Cl.[6] ..... A45C 5/12; A45C 5/14; A45C 13/28; A45C 13/34

[52] U.S. Cl. ..... 190/109; 190/18 A; 190/39; 190/115; 190/111; 190/114; 190/119; 206/320; 383/33

[58] Field of Search ..... 190/109–111, 106, 190/114, 11, 18 A, 115, 902; 206/320; 383/33

[56] References Cited

U.S. PATENT DOCUMENTS

| | | | |
|---|---|---|---|
| 621,732 | 3/1899 | Wyman | 190/902 X |
| 1,099,933 | 6/1914 | Pohrer | 190/18 A X |
| 2,131,583 | 9/1938 | Crotty et al. | 190/111 X |
| 2,334,079 | 11/1943 | Feinberg | 190/111 |
| 2,418,589 | 4/1947 | Lifton | 190/111 X |
| 2,837,185 | 6/1958 | Guenther | 190/111 |
| 3,086,630 | 4/1963 | Wolf | 190/106 X |
| 3,259,217 | 7/1966 | Platt | 190/114 X |
| 3,587,795 | 6/1971 | Berry et al. | 190/114 X |
| 3,904,003 | 9/1975 | Margerum | 190/11 |
| 4,386,642 | 6/1983 | Durbin | 206/520 X |
| 4,693,346 | 9/1987 | Eversdijk | 190/111 |
| 4,729,460 | 3/1988 | Kim | 190/109 |
| 4,773,515 | 9/1988 | Kotkins, Jr. | 190/109 X |
| 4,925,021 | 5/1990 | Pulichino, Jr. | 206/279 |
| 4,995,487 | 2/1991 | Plath | 190/18 A |
| 5,010,988 | 4/1991 | Brown | 206/320 |
| 5,086,888 | 2/1992 | Chu | 190/114 X |
| 5,108,119 | 4/1992 | Huang | 190/18 A X |
| 5,160,001 | 11/1992 | Marceau | 190/102 |
| 5,167,306 | 12/1992 | Carrigan, Jr. | 190/18 A |
| 5,217,199 | 6/1993 | Hollingsworth | 206/320 X |
| 5,242,056 | 9/1993 | Zia et al. | 206/576 |
| 5,265,719 | 11/1993 | Wand | 190/109 X |
| 5,427,453 | 6/1995 | Cloessner | 190/111 X |
| 5,431,428 | 7/1995 | Marchwiak et al. | 190/18 A X |
| 5,437,367 | 8/1995 | Martin | 190/11 X |
| 5,485,922 | 1/1996 | Butcher | 190/18 A X |
| 5,489,021 | 2/1996 | Wallingford | 206/214 |
| 5,524,754 | 6/1996 | Hollingsworth | 206/320 |

FOREIGN PATENT DOCUMENTS

| | | | |
|---|---|---|---|
| 640605 | 8/1993 | Australia | 190/111 |
| 2371899 | 7/1978 | France | 190/111 |
| 2409720 | 7/1979 | France | 190/18 A |
| 2480579 | 10/1981 | France | 190/111 |
| 553428 | 6/1932 | Germany | 190/111 |

*Primary Examiner*—Sue A. Weaver
*Attorney, Agent, or Firm*—Price, Gess & Ubell

[57] ABSTRACT

The combination briefcase and computer bag assembly includes a housing member having a bottom member, a plurality of side members, and a pair of pivotable top flap members. One of the side members includes a flexible floating compartment that is dimensionally configured to receive a portable computer. When the portable computer is held in the flexible floating compartment, it will substantially extend in the briefcase enclosure to protect the portable computer. Straps on the top flaps enable a top flap to be held in an open position when fastened about an extendable handle.

19 Claims, 3 Drawing Sheets

COMBINATION BRIEFCASE AND COMPUTER BAG ASSEMBLY

BACKGROUND OF THE INVENTION

1. Field of the Invention

The present invention is directed to a portable traveling bag and, more particularly, a briefcase having a floating storage compartment for safely transporting a personal computer.

2. Description of Related Art

Personal computers are becoming a common traveling item for businessmen. A lap top computer and accessory equipment, such as printer, fax, memory disk, power pack, etc. are used in business travel, and there is a need to safely transport and access this equipment. Additionally, the increasing congestion in airline travel has also dictated that luggage should be fairly compact in order to be carried onto the plane.

In order to further accommodate the needs of a traveler, suitcase and luggage pieces have also incorporated wheel assemblies and extendable handles to assist in their portability. Reference can be made to U.S. Pat. Nos. 4,995,487, 5,108,119, and 5,167,306 for various examples of such luggage. These carrying cases are advantageously used, for example, by sales representatives, lawyers, and other businessmen who have to carry heavy objects and bulky documents. While it is possible to put a lap top computer directly into a briefcase, such a solution would be unacceptable without modifying the briefcase or adding appropriate and space consuming packing material to secure the computer.

Luggage that has been segmented into individual compartments has been known in the prior art to accommodate the particular traveler's usage, such as U.S. Pat. Nos. 2,131,583, 4,925,021, and 4,729,460.

The prior art is still seeking to optimize the ability to provide a traveling bag, such as a briefcase, that also can accommodate the requirements of the business traveler with his computer needs.

OBJECTS AND SUMMARY OF THE INVENTION

The present invention provides a combination briefcase and computer bag assembly, including a bottom member, a plurality of side members, and a pivotable bifurcated top member to provide therein a briefcase enclosure. The pivotable flaps of the top member can pivot outward to provide access to the interior of the briefcase enclosure. At least a pair of wheels can be mounted to the housing member to extend below the exterior of the bottom member. Additionally, a retractable handle can also be positioned to thereby permit the baggage to be translated across a support surface by the user. An opposite side member includes a flexible floating compartment and a side closure member. The flexible floating compartment is dimensionally configured to receive a portable computer and to extend from a first side wall into the interior of the briefcase enclosure. The side closure member can pivot to open or close access to the flexible compartment from the exterior side of the housing member. Thus, the user can access the computer without disturbing the contents of the briefcase enclosure.

A series of flexible straps can be fastened about the periphery of the flexible floating compartment to extend across and releasably secure the computer. The flexible floating compartment can also include double walls with a foam layer in between to hold the computer both firmly and safely adjacent the briefcase enclosure. When a portable computer is strapped into the flexible floating compartment, it will substantially extend within the briefcase enclosure to protect the portable computer. When the portable computer is removed, the flexible compartment can collapse to thereby increase the storage space of the briefcase enclosure. The first side closure member can also be limited in its pivotable movement to provide extra protection to prevent the computer from falling from the briefcase assembly. The side closure member can also have internal storage pockets to hold peripheral computer accessories, such as disks, power packs, etc.

An exterior surface of a pivotable top flap can also include a pair of flexible straps which can be used to secure the pivotable flap into an open position relative to the handle. Thus, if it is desired to have ready access to an open briefcase enclosure, the flap can then be appropriately secured. The straps can overlap each other in a storage configuration on the top of the briefcase.

Thus, an easily portable combination briefcase and personal computer bag assembly can be either carried in a conventional manner with an appropriate handle on the top member, or pulled with an extendable handle so that the briefcase will roll across a support surface. The briefcase enclosure can accommodate the storage of a personal computer, and, if a personal computer is not provided, the flexible floating compartment can be compressed to collapse and thereby provide additional storage space within the briefcase enclosure.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide a combination briefcase and computer bag assembly.

Figure 1:
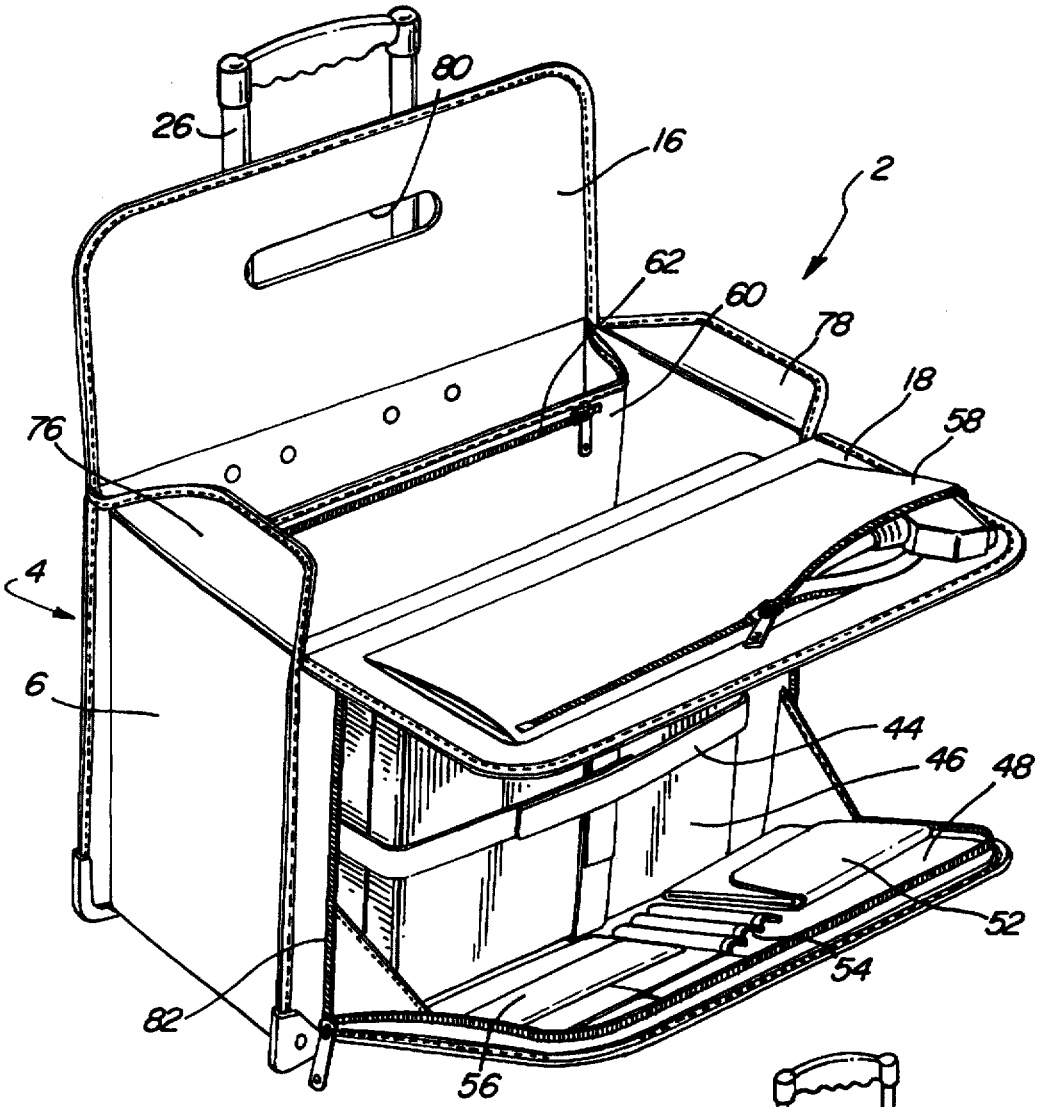
FIG. 1 is a perspective view of the combination briefcase and computer bag assembly of the present invention in an open configuration and containing a lap top computer.
Figure 2:
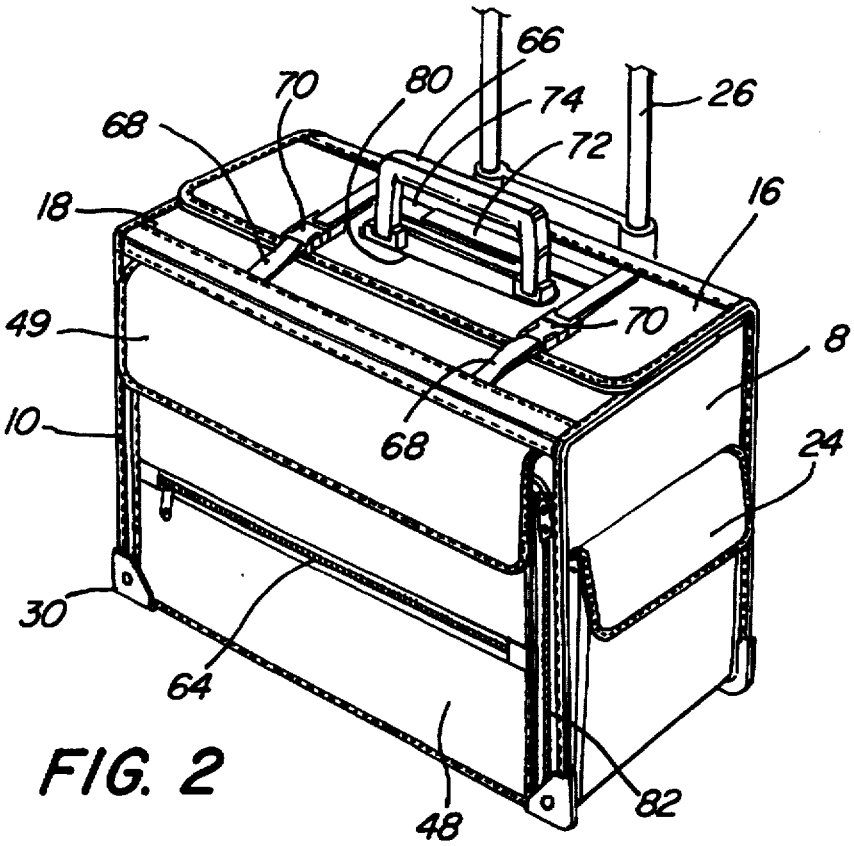
FIG. 2 is a perspective view of the briefcase and computer bag assembly in a closed storage mode.
Figure 4:
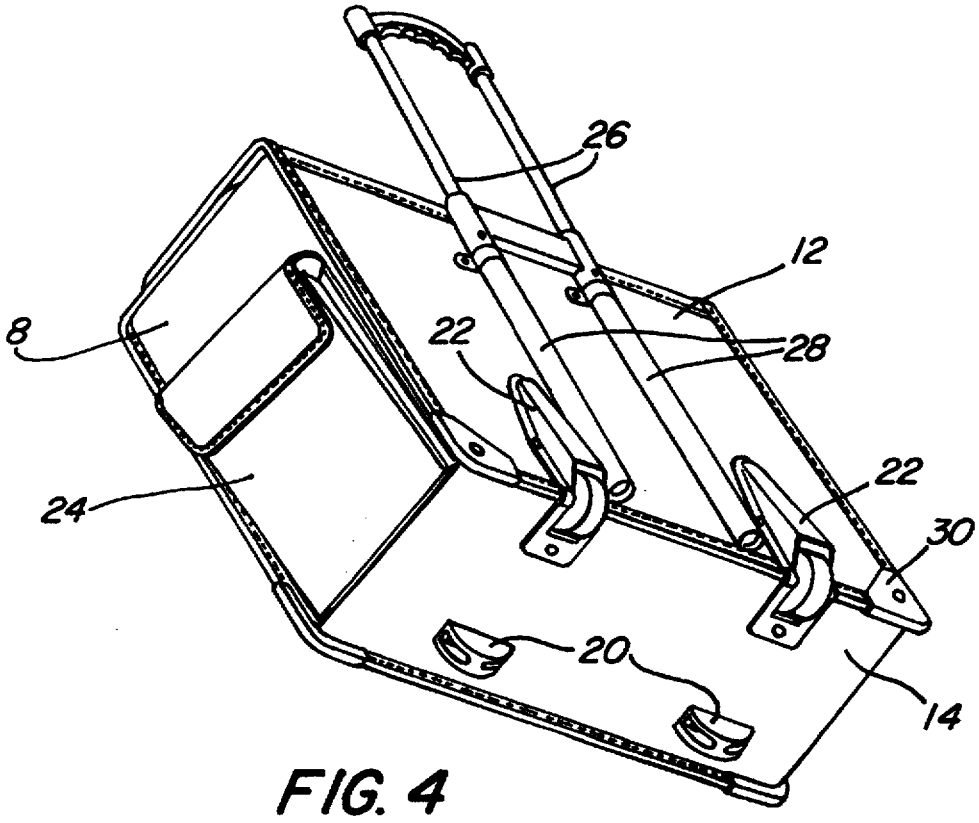
FIG. 4 is a perspective bottom view of the briefcase and computer bag assembly.
Figure 5:
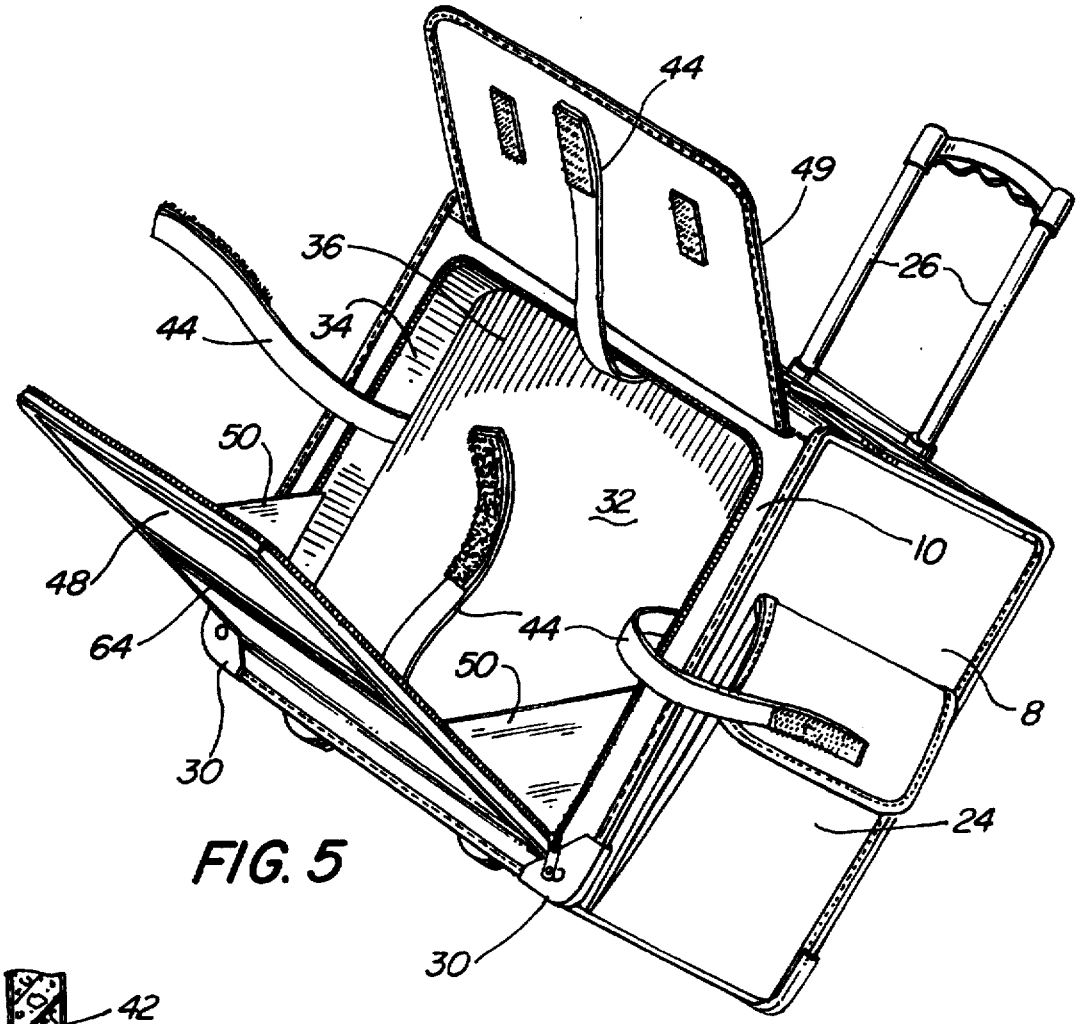
FIG. 5 is a perspective view of the briefcase and computer bag assembly with an open flexible floating compartment.

As shown in FIGS. 1, 2, and 5, a combination briefcase and computer bag assembly 2 includes a housing member 4 having two small side wall members 6 and 8 and a front and back side wall member 10 and 12, respectively. A bottom member 14 completes the structure that forms a briefcase enclosure. A top member can include a pair of pivotable flap members 16 and 18. In a preferred embodiment, the assembly 2 has a relatively semi-rigid exterior construction of the type expected from a thick leather legal briefcases.

The bottom member 14 can be provided with a pair of support pedestals 20, made from a plastic or metal material, that can be secured to an internal reinforcement support member, not shown, beneath the exterior covering of the bottom member 14. The exterior covering can be formed from a polyweb material with a polyvinyl chloride backing, however, other materials can be used. Basically, the side wall members 6, 8, the top flap members 15, 18, and the bottom member 14 have internal reinforcement members, such as plates or partitions of plastic and/or fiber board, that are covered with external and internal sheets of a flexible material. Reference can be made to our co-pending U.S. Ser. No. 541,934, filed on Oct. 10, 1995, for a Traveling Bag Detachably Housing a Portable Computer for an example of one form of construction.

A pair of wheel assemblies 22 can be mounted at the lower section of the rear side wall 12 and extend onto the bottom member 14. The height of the support pedestals 20 correspond to the bottom extension of the wheel assemblies 22 to permit a level horizontal position for the briefcase and computer bag assembly 2. The wheel assemblies 22 can be partially recessed to provide a curve guard and end caps 30 can be located at each of the corners of the luggage structure for further support. The side wall 8 can include an expandable storage pocket 24 which can include a closing flap secured, for example, by snap fasteners or a Velcro™ closure system. A U-shaped handle 26 can be telescoped or extended from its storage tubes 28 to enable the briefcase and computer bag assembly 2 to be translated across a support surface. The dimensional size of the briefcase and computer bag assembly 2 is designed to enable it to be pulled along the aisle of an airplane and to be stored as a carry-on in the overhead luggage compartment of a plane.

Figure 6:
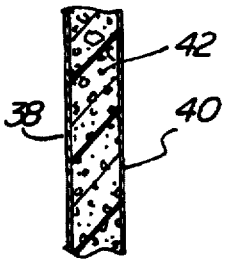
FIG. 6 is an enlarged cross-sectional view of a wall of the flexible floating compartment.

The side wall 10 incorporates a flexible floating compartment 32 that is dimensioned to receive a lap top computer 46. The flexible compartment 32 has a perimeter wall 34 and a partition wall 36, whose cross-section can be formed, as shown in FIG. 6, by an inner and outer covering, such as nylon fabric 38 and 40, that encloses a flexible resin foam support material 42. This construction provides extra protection for the lap top computer 46 when it is mounted within the flexible floating compartment 32. Referring to FIG. 5, the perimeter wall 34 is connected to the first side wall 10 and extends inward within the briefcase enclosure. A series of flexible web straps 44 having Velcro™ fasteners at their ends are used to securely hold a lap top computer 46 in the flexible floating compartment 32, as shown in FIG. 1.

The front side wall 10 includes a closure member 48, as seen in FIGS. 1 and 5, with an appropriate semi-rigid support member (not shown), which can pivot to the extent permitted by the web members 50 to provide an extra amount of protection for the lap top computer 46, as it is being released from the fastening straps 44. The web member 50 limits the extent of opening of the closure member 48 to approximately 140° to 150° from a vertical plane, thereby ensuring a safety position if the computer 46 is accidentally released from the flexible floating compartment 32. The interior face of the closure member 48 can support appropriate storage compartments, such as an expandable pocket 52, pen and pencil sleeves 54, and pocket member 56 dimensioned to secure memory disks for computers.

The closure member 48 can include a peripheral zipper assembly 82 to provide a secure fastening to the side wall 10. An upper side flap 49 can overlap the closure member 48, as shown in FIG. 2 and can be secured to the closure member 48 by Velcro™ fastening strips (not shown).

The upper flap member 18 can also have a zippered storage pocket 88 dimensioned to secure various computer accessory equipment, such as power cables. The briefcase enclosure can also be subdivided by a separator 60 and can include a zippered storage pocket 62. Additionally, the exterior surface of the closure member 48 can have a zippered pocket 64. The top surface of the flap member 18 supports a pivotally mounted handle 66, as seen in FIG. 2. Additionally, snap fasteners 68 are positioned on mounting straps and can be secured to complementary snap fasteners 70, mounted on the exterior of the flap member 16. The snap fasteners can be plastic buckles or other types of fasteners.

Also mounted on the exterior of the flap member 16 are a pair of webbed straps 72 and 74 having appropriate Velcro™ fastening material, such as nap material at one end of a strap, and a plurality of hook material at the other end of the other strap. The straps are shown in the storage position in FIG. 2 and in an operative position in FIG. 3.

Figure 3:
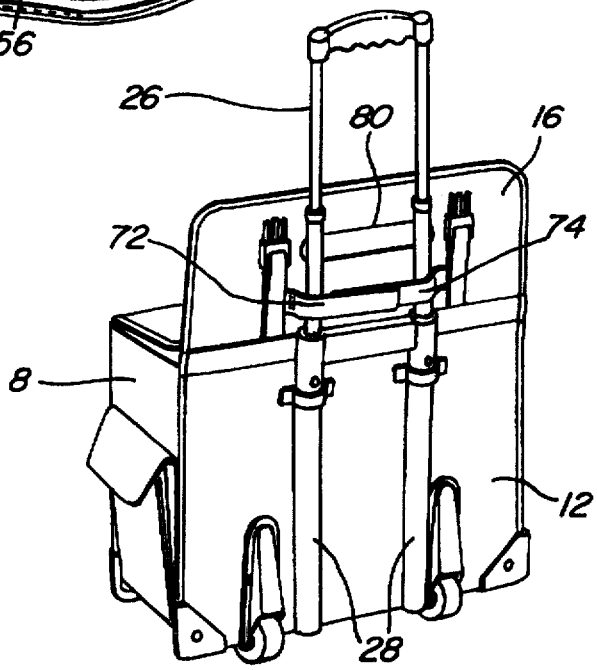
FIG. 3 is a perspective rear view of the briefcase and computer bag assembly with the top flap member strapped to an open position.

Referring to FIG. 3, the straps 72 and 74 can be removably fastened about the U-shaped handle member 26 to thereby advantageously hold the flap 16 in an open position to provide ready access to the briefcase enclosure. Other forms of straps and fasteners can be used to fasten the top flap 16 to the extendable handle 26.

The sidewall 6 and sidewall 8 can have upper small flap members 76 and 78, which can fold inward prior to the closing of the flap member 18 followed by the subsequent closing of the flap member 16 with an oblong hole 80 for accommodating the handle 66.

Referring to FIG. 5, a lap top computer 46 can be mounted within the flexible floating compartment 32, which has been dimensionally designed to conform to the parameters of most popular models of lap top computers. The walls of the flexible floating compartment 32 have an inner lining of a foam material 42 to provide extra protection for the lap top computer. The straps 44, with appropriate fasteners that permit an adjustable positioning, can be closed over the lap top computer 46, as shown in FIG. 1. When the closure member 48 is pivoted to a closed position, zipper assembly 82 is engaged, to ensure a tight fit of the closure member 48 with the remainder of the front side 10.

Figure 7:
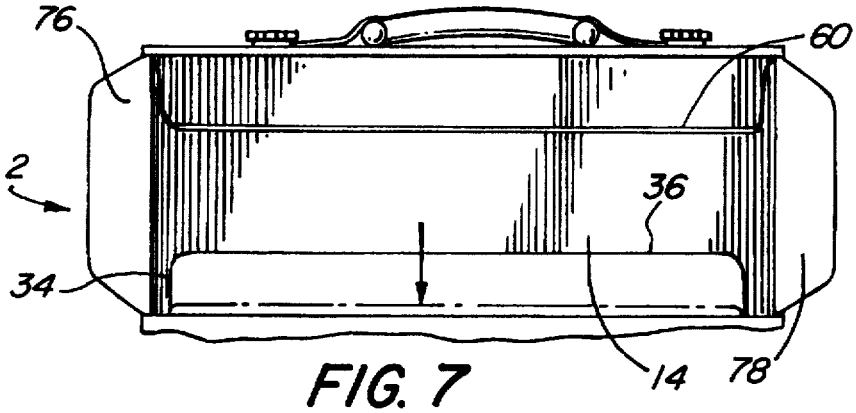
FIG. 7 is a top schematic view showing the flexible floating compartment extended and in phantom lines compressed.

The flexible floating compartment 32 will now be extended inward into the briefcase enclosure with the flap 49 pivoted downward to ensure further protection, as shown in FIG. 2. The user can extend the handle 26 to pull the briefcase and computer bag assembly 2 to the desired location. The user can easily access the lap top computer 46 through the first exterior side 10 of the assembly 2. When the lap top computer 46 is removed, the flexible floating compartment 32 can be collapsed to provide additional storage in the briefcase enclosure with with the partition wall 36 collapsed, as shown in phantom lines in FIG. 7.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A combination briefcase and computer bag assembly comprising:

a semi-rigid housing member having a bottom member, a plurality of side members, and a movable top member to provide a briefcase enclosure above the bottom member, the bottom member is connected to the side members at a perimeter of the bottom member and is relatively non-movable, three of said side members extend upward from the bottom member and are non-movable relative to the bottom member;

the top member can move to provide access to an interior of the housing member which forms the briefcase enclosure;

a fourth side member of the said side members extends upward from the bottom member and includes an internal flexible floating compartment connected to and extending inward from said fourth side member and a semi-rigid exterior side closure member movably connected to the fourth side member, the side closure member is dimensioned to open and close the flexible floating compartment to only permit access to the floating compartment through the fourth side member, the flexible floating compartment includes a flexible perimeter wall connected to the fourth side member and a flexible partition wall connected to the flexible perimeter wall, the flexible perimeter wall and the flexible partition wall dimensionally configured to receive a portable computer and to be projected into the interior of the housing member to occupy a portion of the briefcase enclosure when storing a portable computer, the flexible perimeter wall can be collapsed when the portable computer is removed to be retracted from the briefcase enclosure to thereby expand a storage volume of the briefcase enclosure; and holding means for removably extending across an opening of the flexible floating compartment when the side closure member is opened to retain a portable computer within the flexible floating compartment, whereby when a portable computer is held in the flexible floating compartment by the holding means and the side closure member is closed, the portable computer, will substantially extend within the briefcase enclosure to protect the portable computer, and when the portable computer is removed, the flexible floating compartment can collapse to increase the storage space of the briefcase enclosure.

2. The assembly of claim 1 wherein the side closure member includes storage pockets of a dimensional shape to hold computer memory disks.

3. The assembly of claim 1 further including at least a pair of wheels mounted to the housing member to extend below an exterior of the bottom member for translating the combination briefcase and computer bag across a support surface.

4. The assembly of claim 3 further including an extendable handle member mounted to the housing member for extending above the top member to permit a user to pull the combination briefcase and computer bag.

5. The assembly of claim 4 wherein the top member is bifurcated into a pair of overlapping pivotable flaps.

6. The assembly of claim 5 wherein an exterior surface of one of the pivotable flaps includes means for removably securing the pivotable flap to the handle member to hold it in an open position.

7. The assembly of claim 6 wherein the means for removably securing the pivotable flap includes a pair of straps fastened to an exterior of the pivotable flap.

8. The assembly of claim 7 wherein one strap has a nap material and the other strap has a plurality of hooks that can removably engage and fasten to the nap material.

9. A combination briefcase and computer bag assembly comprising:

a semi-rigid housing member having a bottom member, a plurality of side members, and a movable top member to provide a briefcase enclosure above the bottom member, the bottom member is connected to the side members at a perimeter of the bottom member and is relatively non-movable, three of said side members extend upward from the bottom member and are non-movable relative to the bottom member;

the top member can pivot upward to provide access to an interior of the housing member which forms the briefcase enclosure;

a fourth side member of the said side members extends upward from the bottom member and includes a flexible compartment connected to and extending inward from said fourth side member and a semi-rigid exterior side closure member movable connected to the fourth side member, the side closure member is dimensioned to open and close the flexible floating compartment to only permit access to the floating compartment through the fourth side member, the flexible floating compartment includes a flexible perimeter wall connected to the fourth side member and a flexible partition wall connected to the flexible perimeter wall, the flexible perimeter wall and the flexible partition wall are dimensionally configured to receive a portable computer and to be projected into the interior of the housing member to occupy a portion of the brief case when storing a portable computer, the flexible perimeter wall can be collapsed when the portable computer is removed to be retracted from the briefcase enclosure to thereby expand storage volume of the briefcase enclosure;

means for limiting the pivoting of the side closure member so that it is juxtapositioned outward from a lower edge of the flexible floating compartment;

holding means for removably extending across an opening of the flexible floating compartment when the side closure member is opened to retain a portable computer within the flexible floating compartment;

at least a pair of wheels mounted to the housing member to extend below an exterior of the bottom member for translating the combination briefcase and computer bag across a support surface; and a telescoping handle member mounted to the housing member for retractably extending above the top member to permit a user to pull the combination briefcase and computer bag assembly whereby when a portable computer is held in the flexible floating compartment by the holding means and the side closure is closed, the portable computer will substantially extend within the briefcase enclosure to protect the portable computer, and when the portable computer is removed, the flexible floating compartment can collapse to increase the storage space of the briefcase enclosure.

10. The assembly of claim 9 wherein the top member is bifurcated into a pair of overlapping pivotable flaps and an exterior surface of one of the pivotable flaps includes a pair of straps fastened to an exterior of the pivotable flap for removably securing the pivotable flap to the handle member to hold it in an open position.

11. The assembly of claim 10 wherein one strap has a nap material and the other strap has a plurality of hooks that can removably engage and fasten to the nap material.

12. A combination briefcase and computer bag assembly comprising:

a semi-rigid housing member having a bottom member, a plurality of side members, and a movable top member to provide a briefcase enclosure above the bottom member, the bottom member is connected to the side members at a perimeter of the bottom member and is relatively non-movable, three of said side members extend upward from the bottom member and are non-movable relative to the bottom member;

the top member is bifurcated into a pair of overlapping pivotable flaps that can pivot upward to provide access to an interior of the housing member which forms the briefcase enclosure;

means for removably securing the top member in an open position;

a fourth side member of the said side members extends upward from the bottom member and includes a flexible floating compartment connected to and extending inward from said fourth side member and a semi-rigid exterior closure member movably connected to the fourth side member, the side closure member is dimensioned to open and close the flexible floating compartment to only permit access to the floating compartment through the fourth side member, the flexible floating compartment includes a flexible perimeter wall connected to the fourth side member and a flexible partition wall connected to the flexible perimeter wall, the flexible perimeter wall and the flexible partition wall are dimensionally configured to receive a portable computer and to be projected into the interior of the housing member to occupy a portion of the briefcase when storing a portable computer, the flexible wall can be collapsed when the portable computer is removed to be retracted from the briefcase enclosure to thereby expand a storage volume of the briefcase enclosure;

holding means for removably extending across an opening of the flexible floating compartment when the side closure member is opened to retain a portable computer within the flexible floating compartment;

means for limiting the opening of the side closure member so that it is juxtapositioned outward from a lower edge of the flexible floating compartment;

at least a pair of wheels mounted to the housing member to extend below an exterior of the bottom member for translating the combination briefcase and computer bag across a support surface; and an extendable handle member mounted to the housing member for extending above the top member for extending above the top member to permit a user to pull the combination briefcase and computer bag when a portable computer is held in the flexible floating compartment by the holding means and the side closure member is closed, the portable computer will substantially extend within the briefcase enclosure to protect the portable computer, and when the portable computer is removed, the flexible floating compartment can collapse to increase the storage space of the briefcase enclosure.

13. The assembly of claim 12 wherein the side closure member includes storage pockets of a dimensional size to hold computer memory disks.

14. The assembly of claim 12 wherein an exterior surface of one of the pivotable flaps supports the means for removably securing the top member so that the pivotable flap is removably secured to the handle member to hold it in an open position.

15. The assembly of claim 12 wherein the means for removably securing includes a pair of straps fastened to an exterior of the pivotable flap.

16. The assembly of claim 15 wherein one strap has a nap material and the other strap has a plurality of hooks that can removably engage and fasten to the nap material.

17. A briefcase comprising:

a housing member having a bottom member, a plurality of side members, and a movable top member to provide a briefcase enclosure;

the top member can pivot upward to provide access to the interior of the housing member which forms the briefcase enclosure;

at least a pair of wheels are mounted to the housing member to extend below an exterior of the bottom member for translating the briefcase across a support surface;

an extendable handle member is mounted to the housing member for extending above the top to permit a user to pull the briefcase; and an exterior surface of the top member includes a fastener assembly for removable securement of the top member to the handle member so that the top member can be held in and open position to facilitate access to the interior of the housing member.

18. The briefcase of claim 17 wherein the fastener assembly includes a pair of straps fastened to an exterior of the pivotable top member.

19. The briefcase of claim 18 wherein one strap has a nap material and the other strap has a plurality of hooks that can removably engage and fasten to the nap material.

* * * * *